US010024268B2

(12) United States Patent
Kim et al.

(10) Patent No.: US 10,024,268 B2
(45) Date of Patent: Jul. 17, 2018

(54) CYLINDER COOLING APPARATUS FOR ENGINE

(71) Applicant: Hyundai Motor Company, Seoul (KR)

(72) Inventors: Jong Hyuck Kim, Suwon-si (KR); Yoon Han Eo, Gunpo-si (KR); Eun Ho Lee, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/336,571

(22) Filed: Oct. 27, 2016

(65) Prior Publication Data

US 2017/0276090 A1 Sep. 28, 2017

(30) Foreign Application Priority Data

Mar. 24, 2016 (KR) ..... 10-2016-0035086

(51) Int. Cl.

| | |
|---|---|
| ***F01P 7/14*** | (2006.01) |
| ***F02F 1/40*** | (2006.01) |
| ***F01P 3/02*** | (2006.01) |
| ***F01P 3/20*** | (2006.01) |
| ***F01P 5/10*** | (2006.01) |
| ***F02F 1/10*** | (2006.01) |

(52) U.S. Cl.

CPC ..... *F02F 1/40* (2013.01); *F01P 3/02* (2013.01); *F01P 3/20* (2013.01); *F01P 5/10* (2013.01); *F01P 7/14* (2013.01); *F02F 1/10* (2013.01); *F01P 2007/146* (2013.01)

(58) Field of Classification Search

CPC .... F02M 25/028; F02M 25/035; F02B 47/02; F02F 1/40; F02F 1/10; F01P 3/02; F01P 5/10; F01P 3/20; F01P 7/14; F01P 2007/146

See application file for complete search history.

(56) References Cited

U.S. PATENT DOCUMENTS

2014/0116404 A1* 5/2014 Piper ..... F02M 25/0227 123/568.12

FOREIGN PATENT DOCUMENTS

| | | | |
|---|---|---|---|
| JP | H 08158952 | A | 6/1996 |
| JP | 2007-23918 | A | 2/2007 |
| JP | 2010-248988 | A | 11/2010 |
| KR | 10-1999-0060385 | A | 7/1999 |
| KR | 10-2001-0086423 | A | 9/2001 |
| KR | 10-0905275 | B1 | 6/2009 |
| KR | 10-2015-0020880 | A | 2/2015 |

* cited by examiner

*Primary Examiner* — Hung Q Nguyen
(74) *Attorney, Agent, or Firm* — Morgan, Lewis & Bockius LLP

(57) ABSTRACT

A cylinder cooling apparatus for an engine may include a plurality of intake ports disposed in a cylinder head and communicating with a corresponding plurality of cylinders, a water supply line extending inside from a side of the cylinder head and communicating with the intake ports, and a water pump supplying water to the intake ports through the water supply line.

5 Claims, 1 Drawing Sheet

CYLINDER COOLING APPARATUS FOR ENGINE

CROSS REFERENCE TO RELATED APPLICATION

The present application claims priority to Korean Patent Application No. 10-2016-0035086, filed Mar. 24, 2016, the entire contents of which is incorporated herein for all purposes by this reference.

BACKGROUND OF THE INVENTION

Field of the Invention

The present invention relates to a cylinder cooling apparatus for an engine that is integrated with a cylinder head to cool an engine cylinder.

Description of Related Art

Recently, restrictions on exhaust gas have been enforced around the world. Accordingly, a water injection system to solve the exhaust gas issues has been actively developed.

Water injection literally refers to a technique of spraying water on an engine. That is, the inside of an engine is at a high temperature under high pressure for the characteristics of repetitive compression and explosion, and the water injection technique thus reduces the temperature of the engine by spraying the cooling water.

Accordingly, the temperature of an engine decreases and condensation of air increases, so it is possible to achieve the effects of prevention of knocking and improvement of lifespan, power, and fuel efficiency.

In the related art, water injection is performed to spray water on a surge tank for an intake manifold. However, in this case, it is difficult to accurately distribute water for each cylinder and a lot of water suddenly flows into the intake manifold, thereby potentially causing influence combustion.

Further, in the related art, water injection is performed using an additional injector for spraying water on a combustion chamber. However, it is disadvantageous in terms of cost and package volume to provide an additional injector, and a liner may rust or poor combustion may be caused due to wall wetting.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cylinder cooling apparatus for an engine, wherein the apparatus has a supply line integrated with a cylinder head to directly spray water to a cylinder, thereby improving combustion stability by more accurately distributing water to each cylinder of an engine.

According to various aspects of the present invention, a cylinder cooling apparatus for an engine may include a plurality of intake ports disposed in a cylinder head and communicating with a corresponding plurality of cylinders, a water supply line extending inside from a side of the cylinder head and communicating with the intake ports, and a water pump supplying water to the intake ports through the water supply line.

A plurality of connection holes extending downward to communicate with the cylinders may be formed at a center of the water supply line.

The apparatus may further include a valve disposed at a side of the cylinder head, connected to an end of the water supply line, and controlling an amount of the water supplied to the intake ports from the water pump.

The water pump may be disposed outside the cylinder head and supplies water to the valve.

The apparatus may further include a pressurizer disposed between the valve and the water pump to compress the water supplied to the valve.

The water pump may supply water remaining in a water tank to the intake ports, and at least one of air-conditioner condensate water, water separated from fuel, water separated from oil, and water discharged from a fuel cell flows into the water tank.

According to the cylinder cooling apparatus for an engine having the structure described above, it is possible to advance the point of time of ignition by reducing the temperature of a combustion chamber, so it is possible to improve output and torque.

Further, since a water supply line is integrated with a cylinder head, it is possible to optimally distribute water to each cylinder.

Further, the ratio of complete combustion is increased, so running efficiency is improved. Furthermore, there is no wall wetting, so the durability of a liner is improved and the maintenance cost can be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
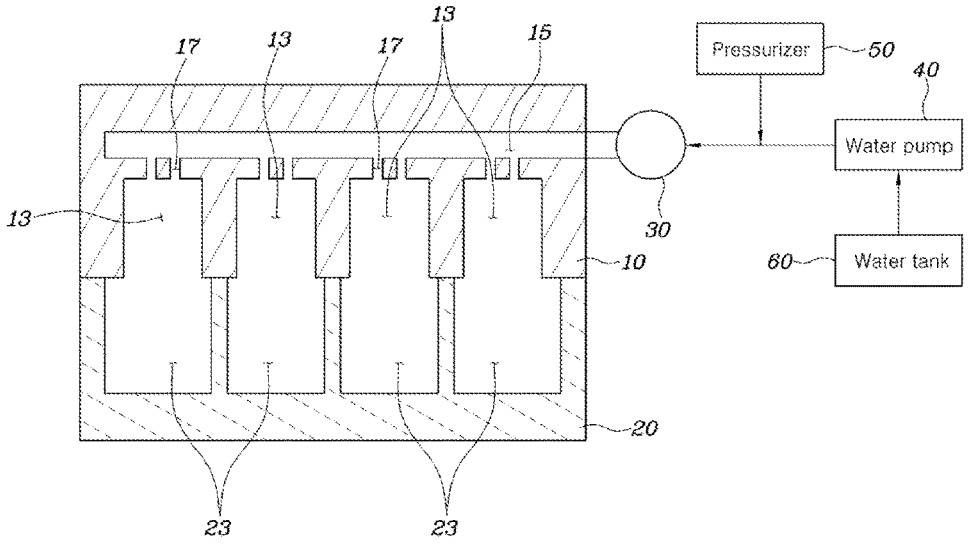
FIG. 1 is a block diagram showing a cylinder cooling apparatus for an engine according to various embodiments of the present invention.
Figure 2:
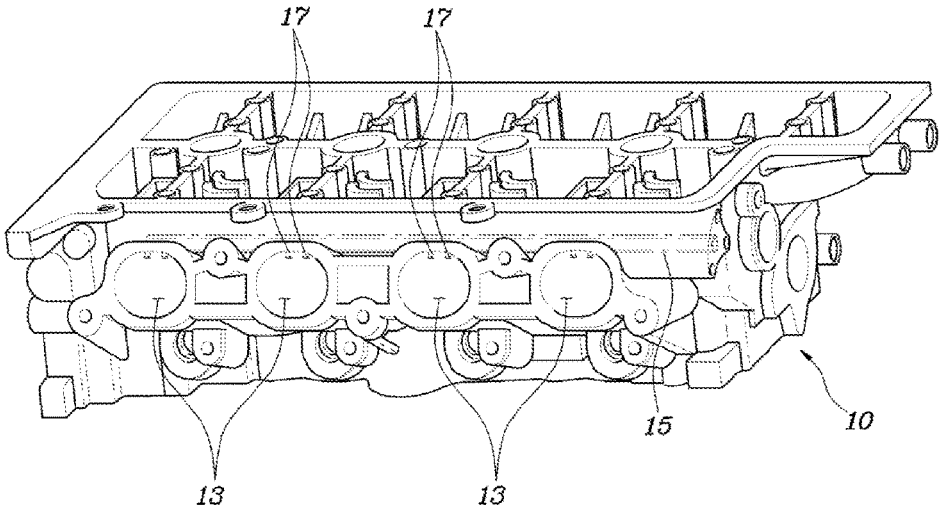
FIG. 2 is a perspective view showing the cylinder cooling apparatus for an engine according to various embodiments of the present invention.

FIG. 1 is a block diagram showing a cylinder cooling apparatus for an engine according to various embodiments of the present invention and FIG. 2 is a perspective view showing the cylinder cooling apparatus for the engine according to various embodiments of the present invention. Referring to FIGS. 1 and 2, a cylinder cooling apparatus for an engine may include a plurality of intake ports 13 that is disposed in a cylinder head 10 and communicate with a plurality of cylinders 23, respectively, a water supply line 15 that extends inside from a side of the cylinder head 10 and communicates with the intake ports 13, and a water pump 40 that supplies water to the intake ports 13 through the water supply line 15.

The intake ports 13 are disposed at the lower end of the cylinder head 10 and a cylinder block 20 is coupled to the lower portion of the cylinder head 10. The cylinders 23 are disposed at the upper end of the cylinder block 20 and form closed spaces with the cylinder head 10. Though not shown in FIG. 1, intake valves may be disposed between the cylinders 23 and the intake ports 13 to control the point of time when air and water flow into the cylinders 23 through the intake ports 13.

In various embodiments, the water pump 40 supplies water directly to the intake ports 13 through the water supply line 15 extending into the cylinder head 10, thereby cooling the cylinders 23. Accordingly, the internal temperature of the cylinders 23 is effectively reduced, so the amount of air that can flow inside increases, and accordingly, explosion can be increased and engine performance can be improved.

In particular, since the water supply line 15 directly communicates with the intake ports 13 in the cylinder head 10, it is possible to optimally control the flow rate of water that is supplied to the cylinders, as compared with the condition in which water is supplied to a surge tank in the related art. Further, the water supply line 15 is integrally or monolithically formed when the intake ports 13 and the cylinder head 10 are molded, so manufacturing is simple and the manufacturing cost is low.

On the other hand, a plurality of connection holes 17 extending downward to communicate with the cylinders 23 may be formed at the center of the water supply line 15.

That is, the intake ports 13 extend from the front end to the rear end of the cylinder head 10 and the water supply line 15 extends from an end to another end of the cylinder head 10 above the intake ports 13. Accordingly, the connection holes 17 extend downward from the water supply line 15 to correspond to the intake ports 13, respectively, so the water flowing in the water supply line 15 can naturally flow into the intake ports 13 by its own weight.

Further, the cylinder cooling apparatus for an engine according to various embodiments of the present invention may further include a valve 30 that is disposed at a side of the cylinder head 10, is connected to an end of the water supply line 15, and controls the amount of water to be supplied to the intake ports 13 from the water pump 40.

That is, the valve 30 is disposed at a side of the cylinder head 10 and may control the amount of water to flow into the water supply line 15. Accordingly, it is possible to optimally control the amount of water to be supplied to each cylinder. The valve 30 may be a solenoid valve and may be controlled by a controller, e.g., an engine control unit (ECU) to be opened and closed, depending on the state of the engine. However, this configuration may be changed, depending on vehicles.

Further, the water pump 40 may be disposed outside the cylinder head 10 to supply water to the valve 30. A pressurizer 50 that pressurizes the water to be supplied to the valve 30 may be further disposed between the valve 30 and the water pump 40. That is, it is possible to increase the filling efficiency for the cylinders by compressing the water supplied from the water pump 40. The pressurizer 50 may be used as a turbocharger, a fuel pump, an oil pump, or an assistant air sprayer, depending on vehicles.

Further, the water pump 40 supplies water remaining in a water tank 60 to the intake ports 13, and at least one of air-conditioner condensate water, water separated from fuel, water separated from oil, or water discharged from a fuel cell flows into the water tank 60.

That is, the evaporator of the air-conditioning system generally produces water in cooling in vehicles, but the water is supplied to the water tank 60, whereby water for cooling cylinders can be supplemented. Alternatively, if a vehicle is equipped with a part that extracts water from fuel or engine oil, it may be possible to supply water obtained by a water separator to the water tank 60. Further, in a hydrogen fuel cell vehicle, it is possible to ensure water for cooling cylinders by supplying water, which is produced by a reaction of hydrogen and oxygen, to the water tank 60. Accordingly, it may not be required to specifically fill the water tank 60 with water or it may be possible to increase the period of filling the water tank 60 with water, so the maintenance cost of a vehicle can be reduced.

In various embodiments of the present invention, since water is not directly injected into the cylinders 23 through the water line 15, but is supplied through the intake ports 13, it is possible to prevent wall wetting due to spraying of water, so it is possible to increase corrosion resistance of a liner.

According to the cylinder cooling apparatus for an engine having the structure described above, it is possible to advance the point of time of ignition by reducing the temperature of a combustion chamber, so it is possible to improve output and torque.

Further, since a water supply line is integrated with a cylinder head, it is possible to optimally distribute water to each cylinder.

Further, the ratio of complete combustion is increased, so running efficiency is improved. Furthermore, there is no wall wetting, so the durability of a liner is improved and the maintenance cost can be reduced.

For convenience in explanation and accurate definition in the appended claims, the terms “upper” or “lower”, “inner” or “outer” and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cylinder cooling apparatus for an engine, comprising:

a plurality of intake ports disposed in a cylinder head and communicating with a corresponding plurality of cylinders;

a water supply line extending inside from a side of the cylinder head and communicating with the intake ports;

a water pump supplying water to the intake ports through the water supply line;

a valve disposed at a side of the cylinder head, connected to an end of the water supply line, and controlling an amount of the water supplied to the intake ports from the water pump; and a pressurizer disposed between the valve and the water pump and fluidically connected to the valve and the water pump to compress the water supplied to the valve.

2. The apparatus of claim 1, wherein a plurality of connection holes extending downward to fluidically-communicate with the cylinders is formed at a center of the water supply line.

3. The apparatus of claim 1, wherein the water pump is disposed outside the cylinder head and supplies water to the valve.

4. The apparatus of claim 1, wherein the water pump supplies water remaining in a water tank to the intake ports, and at least one of air-conditioner condensate water, water separated from fuel, water separated from oil, and water discharged from a fuel cell flows into the water tank.

5. The apparatus of claim 1, wherein the pressurizer is disposed upstream of the cylinder head.

* * * * *